US007638995B2

(12) United States Patent
Thompsen et al.

(10) Patent No.: US 7,638,995 B2
(45) Date of Patent: Dec. 29, 2009

(54) CLOCKED RAMP APPARATUS FOR VOLTAGE REGULATOR SOFTSTART AND METHOD FOR SOFTSTARTING VOLTAGE REGULATORS

(75) Inventors: Brett J. Thompsen, Dallas, TX (US); Ira G. Miller, Tempe, AZ (US); Eduardo Velarde, Jr., Chandler, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 398 days.

(21) Appl. No.: 11/038,746

(22) Filed: Jan. 18, 2005

(65) Prior Publication Data

US 2006/0158170 A1 Jul. 20, 2006

(51) Int. Cl.
*G05F 1/00* (2006.01)

(52) U.S. Cl. ..... 323/288; 323/238; 323/901

(58) Field of Classification Search ..... 320/166; 323/238, 242, 266, 282, 288, 901, 321, 326
See application file for complete search history.

(56) References Cited

U.S. PATENT DOCUMENTS 5,736,872 A * 4/1998 Sharma et al. ..... 327/3
5,942,881 A * 8/1999 Okada et al. ..... 323/277
6,522,115 B1 * 2/2003 Greitschus ..... 323/288
6,525,517 B1 * 2/2003 Hojo et al. ..... 323/316
2002/0027467 A1 3/2002 Henry
2003/0020442 A1 1/2003 Hwang
2004/0027106 A1 2/2004 Martins
2005/0024033 A1 * 2/2005 Nakata ..... 323/282
2005/0129167 A1 * 6/2005 Heimbigner ..... 377/34
2006/0033477 A1 * 2/2006 Lee et al. ..... 320/166
2006/0104405 A1 * 5/2006 Lewis ..... 377/106

FOREIGN PATENT DOCUMENTS

EP 1 235 333 A2 8/2002

* cited by examiner

*Primary Examiner*—Edward Tso
*Assistant Examiner*—Arun Williams
(74) *Attorney, Agent, or Firm*—Ingrassia, Fisher & Lorenz, PC

(57) ABSTRACT

Methods and apparatus for softstarting a voltage regulation circuit. A circuit for generating an output voltage at an output thereof includes a capacitor having a first terminal configured to be coupled to a reference potential and having a second terminal coupled to the output, and a switchable current source coupled to the capacitor for intermittently charging the capacitor until the output voltage is reached.

13 Claims, 3 Drawing Sheets

-PRIOR ART-

-PRIOR ART-

CLOCKED RAMP APPARATUS FOR VOLTAGE REGULATOR SOFTSTART AND METHOD FOR SOFTSTARTING VOLTAGE REGULATORS

FIELD OF THE INVENTION

The present invention generally relates to voltage regulation, and more particularly relates to a softstart reference voltage generator for voltage regulators.

BACKGROUND OF THE INVENTION

Voltage regulators are commonly used in conjunction with additional electronic components or circuitry to provide a source of voltage at a desired level based on an input voltage from a power supply. In general, voltage regulators are intended to provide a relatively constant output voltage and typically have circuitry that continuously maintain the output voltage at a desired value, regardless of fluctuations in load current or input voltage, provided that the fluctuations are within specified operating ranges.

During start-up of a conventional voltage regulator, the voltage regulator draws current from the power supply. A slow ramp-up of output voltage by the voltage regulator (commonly known as "softstart") is common practice to limit the impact of current demands from the voltage regulator on the power supply. With softstart, the voltage regulator tends to "pull-up" to the desired output voltage by drawing a less demanding amount of current from the power supply. One known voltage regulator is a switching, direct current-to-direct current (DC/DC) converter having a power stage producing the output voltage and a control loop that regulates the output voltage at the desired value. The control loop has an input for a reference voltage that is used to establish a base value for the output voltage. For this DC/DC converter, softstart may be implemented by ramping the reference voltage of the control loop.

A conventional reference ramp generator 20 for ramping the reference voltage of the DC/DC converter is shown in FIG. 1. The reference ramp generator 20 outputs a voltage, $V_{ramp}$, and includes a capacitor 24 having a capacitance (Cap), a first terminal coupled to a voltage controlled current source 22 and a second terminal coupled to a reference potential (e.g., ground). Current source 22 generates a reference current ($I_{ref}$), based on a supply voltage, $V_{dd}$. The ramp voltage ($V_{ramp}$) ramps from the reference potential to the desired reference voltage at a rate, dV/dt, generally depending on the size of capacitor 24 and the value of $I_{ref}$. For the reference ramp 20, the rate of change of $V_{ramp}$ is governed by the equation $$dV=(I_{ref}/\text{Cap})\times dt.$$

FIG. 2 is a graph illustrating the voltage output ($V_{ramp}$) of the reference ramp generator 20 shown in FIG. 1 as a function of time. In integrated circuits (IC) or monolithic devices, the ramp time from the reference potential to the desired reference voltage is generally a function of $I_{ref}$ and Cap as described above. For example, IC devices may have variable characteristics introduced by process control variations and leakage. A minimum reference current (e.g., 1 μA) is typically utilized to maintain accuracy. Additionally, since cost and size limitations generally limit the capacitance to, for example, less than 100 pF, the ramp time is typically limited to a period that is substantially less than one ms. For example, using a bandgap reference voltage of 1.25V, a current of 1 μA and a capacitance of 100 pF, the ramp time of the reference ramp 20 shown in FIG. 1, is:

$$dt=(100\text{ pF}/1\ \mu\text{A})\times 1.25\text{ V}=0.125\text{ ms}.$$

Accordingly, a reference ramp having a longer softstart times than conventional reference ramps is desired for on-chip devices to further reduce impact on the power supply during start-up. In addition, a voltage regulator circuit is desired having a longer softstart time without a substantial increase in the size and cost of the circuit. Furthermore, other desirable features and characteristics of the present invention will become apparent from the subsequent detailed description of the invention and the appended claims, taken in conjunction with the accompanying drawings and this background of the invention.

BRIEF SUMMARY

According to various exemplary embodiments, methods and apparatus are provided for softstarting voltage regulators. In one exemplary embodiment, a circuit for generating an output voltage at an output thereof comprises a capacitor having a first terminal configured to be coupled to a reference potential and having a second terminal coupled to the output, and a switchable current source coupled to the capacitor for intermittently charging the capacitor until the output voltage is reached.

In another exemplary embodiment, a voltage regulation circuit comprises a voltage regulator having an input and configured to generate a supply voltage based on a input voltage, a capacitor having a first terminal configured to couple to a reference potential and having a second terminal coupled to the input, and a switchable current source coupled to the capacitor for intermittently charging the capacitor until the input voltage is reached.

In yet another exemplary embodiment, a method is provided for generating a reference voltage in a voltage regulation circuit having a system clock signal, a switchable current source generating a reference current, and a capacitor coupled to the switchable current source. The method comprising the steps of: generating a first signal having a frequency based on the system clock signal; and, intermittently charging the capacitor at the frequency until the reference voltage is reached.

BRIEF DESCRIPTION OF THE DRAWINGS

The present invention will hereinafter be described in conjunction with the following drawing figures, wherein like numerals denote like elements.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description.

Figure 3:
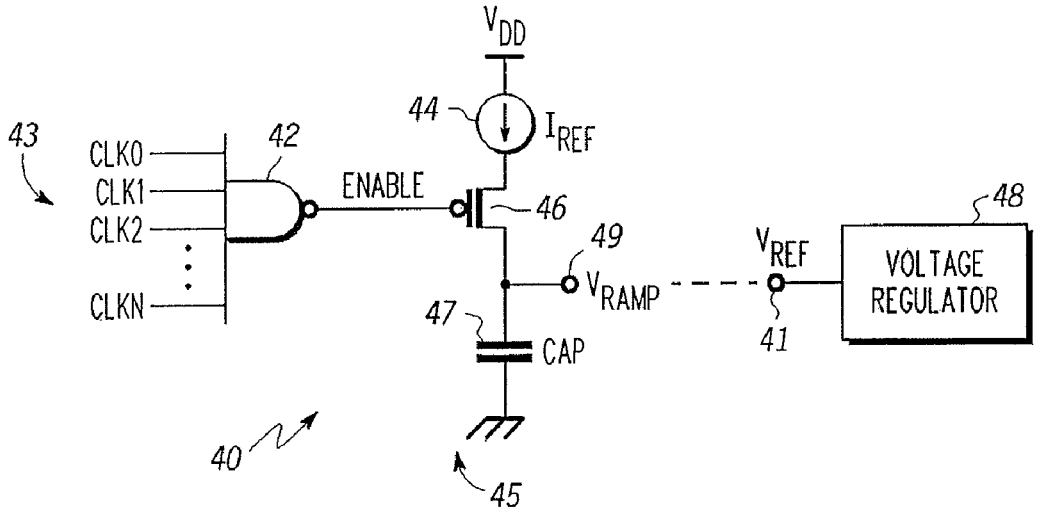
FIG. 3 is a schematic diagram of an exemplary embodiment of a voltage regulation circuit according to the present invention.

According to various embodiments, an apparatus and a method are provided for reference voltage ramping that is well-suited to voltage regulator applications and on-chip devices, such as integrated circuits. Referring to the drawings, FIG. 3 is a schematic diagram of an exemplary embodiment of a voltage regulation circuit 40 according to the present invention. Voltage regulation circuit 40 comprises a reference ramp generator 45 having an output 49 configured to be coupled to a reference input 41 ($V_{ref}$) of a voltage regulator 48. The reference ramp generator 45 produces a voltage ($V_{ramp}$) that ramps up from a reference voltage to $V_{ref}$. The conventional voltage regulator 48 may have a variety of configurations depending on a desired voltage output as is well known to those skilled in the art. Examples of voltage regulators include, but are not limited to, linear regulators, switching regulators (e.g., rectifiers, voltage converters, frequency changers, and inverters), and the like.

In an exemplary embodiment, the reference ramp generator 45 comprises, a voltage controlled current source 44 configured to be coupled to a supply voltage $V_{DD}$ for generating a reference current ($I_{ref}$), a switch 46 having a current-receiving electrode coupled to the current source 44, a capacitor 47 coupled to a current-transmitting electrode of switch 46, and a clock generator 43 having an output coupled to a gate of switch 46. Clock generator 43 periodically turns switch 46 on to permit current from current source 44 to pass therethrough to charge capacitor 47. Capacitor 47 has a capacitance (Cap) and is charged, due to the periodic or intermittent current received from current source 44 through switch 46. Thus, $V_{ramp}$ increments in a stepwise fashion from a reference potential to $V_{ref}$. Although the charging of capacitor 47 is described herein in conjunction with the gating of current from current source 44 by using clock generator 43 and to turn switch 46 on and off, a variety of other switching devices may be used to incrementally charge capacitor 47.

In one exemplary embodiment, the switch 46 is a transistor based device (e.g. an MOS transistor) although a variety of other types of conventional switches for selectively passing current therethrough may be utilized. Additionally, a variety of transistors may be used as switch 46 including, by way of example and not of limitation, field effect transistors, bipolar transistors, and the like. In this exemplary embodiment, MOS switch 46 has a source coupled to the output of current source 44, a drain coupled to capacitor 47, and a gate coupled to the output of clock generator 43 that selectively permits the source-drain path of switch 46 to conduct current from current source 44 in response to a trigger signal received from the clock 43.

Figure 4:
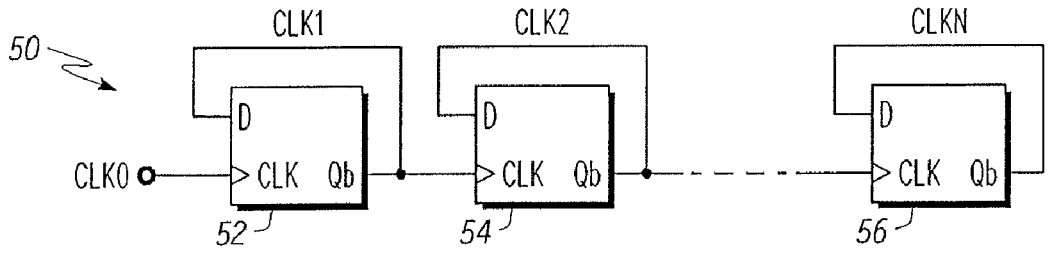
FIG. 4 is a schematic diagram of an exemplary embodiment of a clock for the reference ramp shown in FIG. 3.
Figure 5:
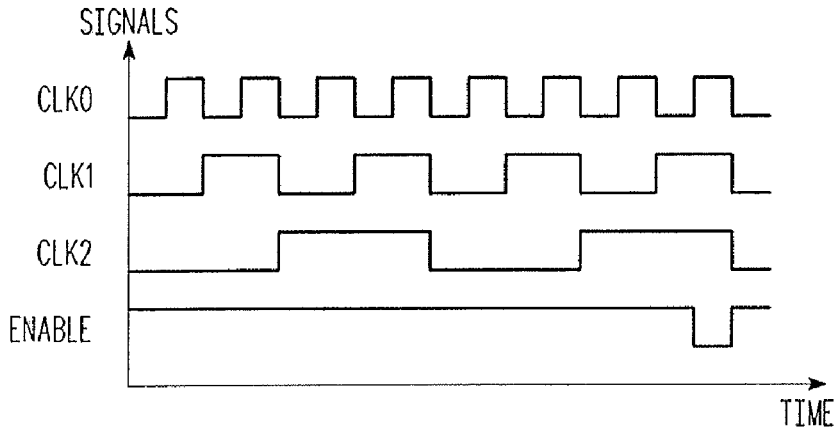
FIG. 5 is a graph illustrating an exemplary embodiment of a timing sequence of the clock shown in FIG. 4.

FIG. 4 is a schematic diagram of an exemplary embodiment of a binary counter 50 for use in the circuit shown in FIG. 3 and FIG. 5 illustrates waveforms produced therein. In this exemplary embodiment, the binary counter 50 includes series connected D-type reset-set (RS) latches or flip-flops 52, 54, 56. The output of a first RS latch 52 is coupled to the input of a second RS latch 54, etc. The first RS latch 52 has an input that receives a system clock signal, (CLK 0) and transmits a signal (CLK 1) to the second RS latch 54. The second RS latch 54 receives CLK 1 from first RS latch 52 and transmits a signal (CLK 2) to a third RS latch 56, etc. Each subsequently connected RS latch receives, as an input signal, the output of the previous RS latch in the series and outputs a signal that has a frequency that is half the frequency of its input signal. The signals CLK 0, CLK 1, CLK 2, . . . CLK N, are then applied to a NAND that produces and provides a periodic trigger signal (ENABLE in FIG. 5) to switch 46. The enable signal (ENABLE) is produced when all three clock signals CLK 0, CLK 1, and CLK 2 are "HIGH" 46. Binary counters of the type shown in FIG. 4 are well known and further discussion is not deemed necessary. It should be noted however, that other logic circuits may be utilized to trigger switch 46 (FIG. 3) on and off so as to intermittently render switch 46 conductive. By intermittently or periodically passing current through switch 46, the amount of time it takes to charge capacitor 47 to the desired $V_{ref}$ is increased thus increasing the softstart time.

Figure 6:
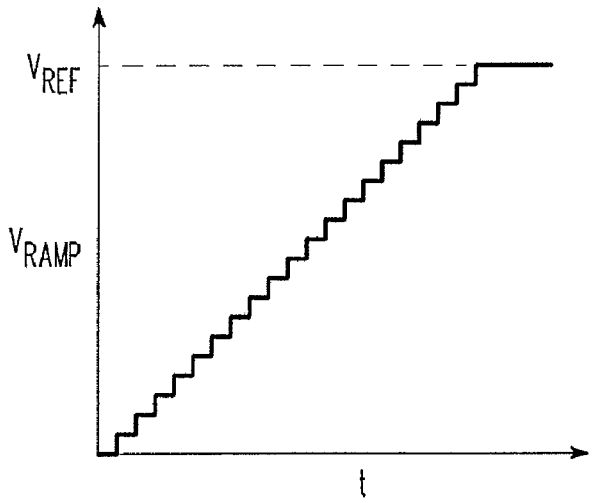
FIG. 6 is a graph illustrating the voltage output of the voltage regulation circuit shown in FIG. 4.

FIG. 6 is a graph illustrating a voltage output ($V_{ramp}$) of the reference ramp 45 shown in FIG. 3 as a function of time. The reference ramp 45 has the effect of dividing the average current of the reference current ($I_{ref}$) over time into a substantially smaller effective reference current, $I_{ref}$ (eff). Using the configuration of n number of series connected D-type RS latches in the clock 50 (FIG. 4), $$I_{ref}(\text{eff})=I_{ref}/2^{(n+1)}.$$

In this exemplary embodiment, the ramp-up time for the capacitor 47 (FIG. 3) to charge to the desired reference voltage (e.g., the time for $V_{ramp}$ to increment from ground to $V_{ref}$) is increased as a function of the number of RS latches, $$dt=\text{Cap}\times dV\times 2^{(n+1)}/I_{ref}.$$

Thus, the inventive circuit produces longer softstart times (e.g., greater than 1 ms) for on-chip applications without decreasing $I_{ref}$ or increasing Cap.

Figure 7:
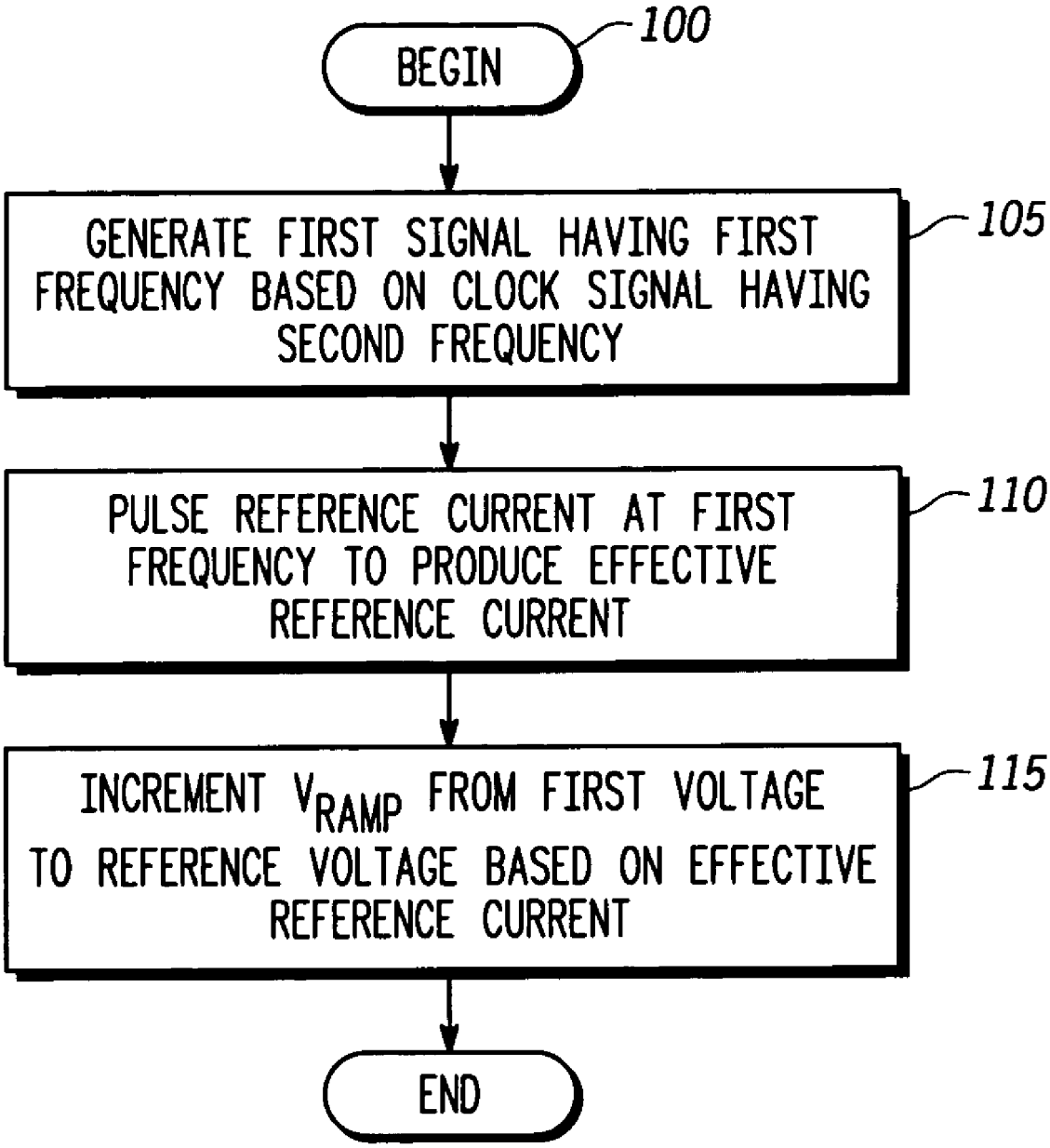
FIG. 7 is a flow diagram of an exemplary embodiment of a method for generating a reference voltage.

FIG. 7 is a flow diagram of an exemplary method for softstarting a voltage regulator. A clock signal, such as the enable signal (ENABLE) shown in FIG. 5, is generated and has a frequency based on a system clock signal (e.g., CLK 0) at step 105. That is, the enable signal is a decoded state of the binary counter comprised of flip-flops 52, 54, and 56 (FIG. 4). In this case, the enable signal corresponds to the logical "LOW" state of NAND gate 42 (FIG. 3) that occurs when all outputs of the counter bits applied to NAND gate 42 are "HIGH" after which the counter recycles thus generating an ENABLE signal each time the counter reaches a 111 state.

Figure 1:
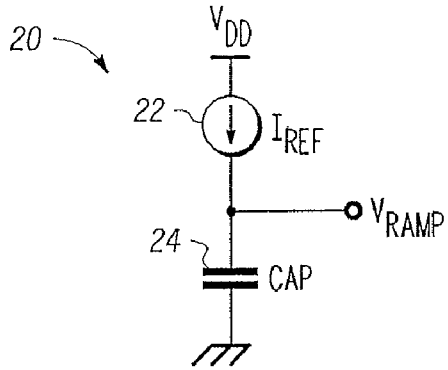
FIG. 1 is a circuit diagram of a conventional reference ramp.
Figure 2:
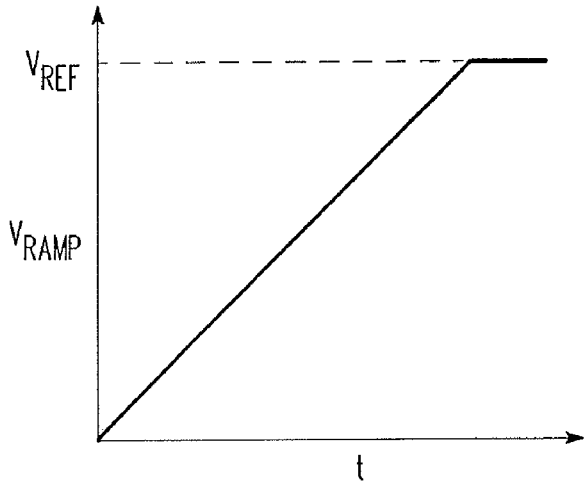
FIG. 2 is a graph illustrating a voltage output of the reference ramp shown in FIG. 1.

Each time the enable signal (ENABLE) goes "LOW", current from current source 44 (FIG. 4) flows through switch 46 to produce a periodic charging current at step 110. As a result, capacitor 47 is periodically charged until $V_{ref}$ is reached at step 115 based on the pulsed reference current from current source 44 (FIG. 3) through switch 46 (FIG. 3). Since capacitor 47 is charged only periodically and not continuously as was the case with the prior art (FIG. 2), longer softstart times are possible.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A circuit for generating an output voltage at an output thereof, the circuit comprising:

a node configured to be coupled to said output;

a capacitor having a first terminal configured to be coupled to a reference potential and having a second terminal coupled to said node; and a switchable current source coupled to said node for intermittently charging said capacitor until the output voltage is reached, said switchable current source comprising:

a current source;

a switch having a first electrode coupled in series with said current source, a second electrode coupled to said node, and a gate electrode; and a clock generator having an output coupled to said gate electrode for periodically turning said switch ON so as to conduct current from said current source to said capacitor.

2. A circuit according to claim 1, wherein said clock generator comprises:

a binary counter; and a decoder coupled to said binary counter for decoding a specific state thereof.

3. A circuit according to claim 2, wherein said binary counter comprises:

at least two reset-set (RS) latches coupled in series, each of said at least two RS latches having an output, a set input, and a reset input, said output of a preceeding RS latch of said at least two RS latches coupled to said reset input of said preceeding RS latch and to said set input of a subsequent RS latch, said set input of a first RS latch of said at least two RS latches configured to receive said second signal; and a NAND gate having inputs coupled to different ones of said outputs of said at least two RS latches and having an output coupled to said gate electrode.

4. A circuit according to claim 3, wherein said clock generator comprises n number of RS latches, said capacitor has a capacitance C, said current source is configured to output a reference current $I_{ref}$, and wherein said switchable current source pulses an effective reference current, $I_{ref}$, for each period dt, such that $$I_{ref}(\text{eff})=I_{ref}/2^{(n+1)} \text{ and } dt+C\times dV\times 2^{(n+1)}/I_{ref}.$$

5. A circuit according to claim 1, wherein said capacitor has a capacitance less than about 100 pF.

6. A circuit according to claim 1, wherein said switchable current source is configured to output a reference current $I_{ref}$ of equal to or greater than about 1 μA.

7. A voltage regulation circuit comprising:

a voltage regulator having an input and configured to generate a supply voltage at an output thereof;

a node coupled to said input;

a capacitor having a first terminal configured to be coupled to a reference potential and having a second terminal coupled to said node; and a switchable current source coupled to said node for periodically charging said capacitor until a predetermined input voltage is reached, said switchable current source comprising:

a voltage-controlled current source;

a switch having a first electrode coupled in series with said current source, a second electrode coupled to said node, and a gate electrode configured to selectively conduct current from said first electrode to said second electrode; and a clock generator coupled to said gate electrode, said clock generator configured to periodically transmit an enable signal to said gate electrode for periodically turning said switch ON.

8. A voltage regulation circuit according to claim 7, wherein said reference potential is a ground.

9. A voltage regulation circuit according to claim 7, wherein said switch is a transistor.

10. A voltage regulation circuit according to claim 7, wherein said clock generator is configured to receive a system clock signal, said clock generator comprising:

at least two reset-set (RS) latches coupled in series, each of said at least two RS latches having an output, a set input, and a reset input, said output of a preceeding RS latch of said at least two RS latches coupled to said reset input of said preceeding RS latch and to said set input of a subsequent RS latch, said set input of a first RS latch of said at least two RS latches configured to receive said system clock signal; and a NAND gate having an input coupled to different ones of said outputs of said at least two RS latches and having an output coupled to said gate electrode.

11. A voltage regulation circuit according to claim 7, wherein said clock comprises n number of RS latches, said capacitor has a capacitance C, said current source is configured to output a reference current $I_{ref}$, and wherein said transistor pulses an effective reference current, $I_{ref}$(eff), for each period dt, such that $I_{ref}(\text{eff})=I_{ref}/2^{(n+1)}$ and $dt=C\times dV\times 2^{(n+1)}/I_{ref}$.

12. A voltage regulation circuit according to claim 7, wherein said capacitor has a capacitance less than about 100 pF.

13. A voltage regulation circuit according to claim 7, wherein said switchable current source is configured to output a reference current $I_{ref}$ equal to or greater than about 1 μA.

* * * * *

UNITED STATES PATENT AND TRADEMARK OFFICE

CERTIFICATE OF CORRECTION

PATENT NO. : 7,638,995 B2
APPLICATION NO. : 11/038746
DATED : December 29, 2009
INVENTOR(S) : Thompsen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 487 days.

Signed and Sealed this

Ninth Day of November, 2010

David J. Kappos

David J. Kappos
*Director of the United States Patent and Trademark Office*